US010450778B2

(12) United States Patent
Bennett et al.

(10) Patent No.: US 10,450,778 B2
(45) Date of Patent: Oct. 22, 2019

(54) LATCH WITH INDICATOR AND LATCH SYSTEM

(71) Applicant: Southco, Inc., Concordville, PA (US)

(72) Inventors: Nicholas Paul Bennett, Redditch (GB); Bernard Edward Abrahams, Birmingham (GB)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 15/567,227

(22) PCT Filed: Apr. 20, 2016

(86) PCT No.: PCT/US2016/028336

§ 371 (c)(1),
(2) Date: Oct. 17, 2017

(87) PCT Pub. No.: WO2016/172138

PCT Pub. Date: Oct. 27, 2016

(65) Prior Publication Data

US 2018/0148952 A1 May 31, 2018

Related U.S. Application Data

(60) Provisional application No. 62/152,215, filed on Apr. 24, 2015.

(51) Int. Cl.
*E05B 63/00* (2006.01)
*E05B 39/00* (2006.01)
(Continued)

(52) U.S. Cl.
CPC ..... *E05B 63/0034* (2013.01); *E05B 39/00* (2013.01); *E05C 3/048* (2013.01); *G07C 1/32* (2013.01); *E05B 15/04* (2013.01)

(58) Field of Classification Search
CPC ..... E05B 63/0034; E05B 39/00; E05B 15/04; E05B 39/04; G07C 1/32; E05C 3/048
(Continued)

(56) References Cited

U.S. PATENT DOCUMENTS 785,228 A * 3/1905 Phelps
943,471 A * 12/1909 Schoell
(Continued)

FOREIGN PATENT DOCUMENTS

CN 201334807 Y 10/2009
EP 0116158 A2 8/1984
GB 2182093 A 10/1986

OTHER PUBLICATIONS

International Preliminary Report on Patentability and Written Opinion for International Application No. PCT/US2016/028336, dated Oct. 24, 2017, 7 pages.
(Continued)

*Primary Examiner* — Lloyd A Gall
(74) *Attorney, Agent, or Firm* — RatnerPrestia

(57) ABSTRACT

Latches and latch systems configured for providing an access indication are disclosed. One latch comprises an actuator, an indicator, and a reset mechanism. The actuator has an unopened position and an opened position. The indicator has a first position in which the indicator provides a first indication and a second position in which the indicator provides a second indication. The indicator is configured to move from the first position to the second position when the actuator is moved from the unopened position toward the opened position. The reset mechanism is configured to move the indicator from the second position to the first position. Once the indicator is moved from the first position to the second position, it is configured to remain in the second position independent of movement of the actuator until the
(Continued)

reset mechanism moves the indicator to the first position from the second position.

22 Claims, 11 Drawing Sheets

(51) Int. Cl.
*E05C 3/04* (2006.01)
*G07C 1/32* (2006.01)
*E05B 15/04* (2006.01)

(58) Field of Classification Search
USPC ..... 70/DIG. 59, 21, 432–441; 116/200, 203, 116/306, 312, 314
See application file for complete search history.

(56) References Cited

U.S. PATENT DOCUMENTS 1,128,307 A * 2/1915 Greely ..... E05B 17/10 362/100
3,126,218 A * 3/1964 Andrews ..... E05B 41/00 292/145
4,465,997 A * 8/1984 Hines ..... E05B 45/086 200/61.68
4,556,244 A 12/1985 Bisbing
4,559,796 A * 12/1985 De Forrest, Sr. ..... E05B 41/00 70/432
4,596,203 A 6/1986 Lorek
4,912,456 A * 3/1990 Mickel ..... G08B 13/06 200/61.67
5,235,833 A * 8/1993 Pinto ..... E05B 39/00 70/210
5,943,886 A * 8/1999 Chiang ..... E05B 65/5238 292/150
6,363,763 B1 * 4/2002 Geringer ..... E05B 45/12 70/432
6,877,345 B1 * 4/2005 Misner ..... E05B 35/105 70/25
6,938,445 B2 * 9/2005 Huang ..... E05B 41/00 70/107
7,415,853 B2 * 8/2008 Yu ..... E05B 37/02 70/21
8,161,778 B1 * 4/2012 Ma ..... E05B 35/007 70/21
8,356,844 B2 * 1/2013 Baic ..... E05B 41/00 292/205
8,544,900 B2 * 10/2013 Elbrecht ..... E05B 13/002 292/100
8,857,230 B1 10/2014 Misner
2002/0116969 A1 * 8/2002 Geringer ..... E05B 45/12 70/432
2004/0187533 A1 * 9/2004 Huang ..... E05B 41/00 70/432
2006/0114103 A1 * 6/2006 Usami ..... G06K 7/0008 340/10.2
2007/0113607 A1 5/2007 Huang
2008/0000277 A1 * 1/2008 Yu ..... E05B 29/00 70/432
2011/0016938 A1 * 1/2011 Chi ..... E05B 41/00 70/432
2015/0225982 A1 * 8/2015 Bronner ..... E05B 63/0017 70/432

OTHER PUBLICATIONS

International Search Report and Written Opinion for International Application No. PCT/US2016/028336, dated Aug. 1, 2016—8 Pages.
Chinese Office Action for Chinese Application No. 201680023874.6, dated Apr. 2, 2019 with translation, 13 pages.

* cited by examiner

LATCH WITH INDICATOR AND LATCH SYSTEM

CROSS-REFERENCE TO RELATED APPLICATIONS

This application is a U.S. National Phase Application of PCT International Application PCT/US2016/028336, filed Apr. 20, 2016, and claims the benefit of priority of, U.S. Provisional Application No. 62/152,215, entitled LATCH WITH INDICATOR AND LATCH SYSTEM, filed on Apr. 24, 2015, the contents of which are incorporated herein by reference in their entirety for all purposes.

FIELD OF THE INVENTION

The present invention relates generally to latch systems, and particularly, to latches that can be used for securing storage compartments.

BACKGROUND OF THE INVENTION

Conventionally, storage compartments in restricted areas (such as medical environments) must be secured to prevent unauthorized access to their contents. For example, storage compartments on ambulances may contain medicines, emergency medical supplies, equipment, and/or hazardous waste that should not be accessed or removed without authorization. Also, it may be desirable to indicate when a compartment has been accessed for inventory control and possible replenishment.

For these types of compartments, it may often be necessary to confirm that the contents of a respective compartment have not been removed or otherwise tampered with, or to confirm whether or not such compartments must be replenished or otherwise attended to. However, individually opening and cataloging the contents of each compartment may be unreasonably time-consuming or difficult.

Accordingly, improved systems and devices are desired for securing and tracking the contents of storage compartments. And there remains a need for latches and latch systems that are improved in terms of at least one of performance, cost, ease of use, and operation.

SUMMARY OF THE INVENTION

Aspects of the present invention are related to latches and latch systems configured for providing an access indication.

In accordance with one aspect of the present invention, a latch configured for providing an access indication is disclosed. The latch comprises an actuator, an indicator associated with the actuator, and a reset mechanism associated with the indicator. The actuator has an unopened position and an opened position. The indicator has a first position in which the indicator provides a first indication and a second position in which the indicator provides a second indication different from the first indication. The indicator is configured to move from the first position to the second position when the actuator is moved from the unopened position toward the opened position. The reset mechanism is configured to move the indicator from the second position to the first position. Once the indicator is moved from the first position to the second position, it is configured to remain in the second position independent of movement of the actuator until the reset mechanism moves the indicator to the first position from the second position.

In accordance with another aspect of the present invention, a latch system is disclosed. The latch system comprises the above-described latch, as well as a key configured to move the indicator from the second position to the first position.

In accordance with yet another aspect of the present invention, a compartment is disclosed. The compartment comprises an opening, a door positioned to limit access to the opening, and the above-described latch. The latch is positioned to selectively prevent movement of the door with respect to the opening.

In accordance with still another aspect of the present invention, an actuator is disclosed. The actuator has an unopened position and an opened position. The actuator is configured for providing an access indication. The actuator comprises an indicator and a reset mechanism associated with the indicator. The indicator has a first position in which the indicator provides a first indication and a second position in which the indicator provides a second indication different from the first indication. The indicator is configured to move from the first position to the second position when the actuator is moved from the unopened position toward the opened position. The reset mechanism is configured to move the indicator from the second position to the first position. Once the indicator is moved from the first position to the second position, it is configured to remain in the second position independent of movement of the actuator until the reset mechanism moves the indicator to the first position from the second position.

BRIEF DESCRIPTION OF THE DRAWINGS

The invention is best understood from the following detailed description when read in connection with the accompanying drawings. It is emphasized that, according to common practice, the various features of the drawings are not to scale. On the contrary, the dimensions of the various features may be arbitrarily expanded or reduced for clarity. Included in the drawings are the following figures.

DETAILED DESCRIPTION OF THE INVENTION

Figure 1:
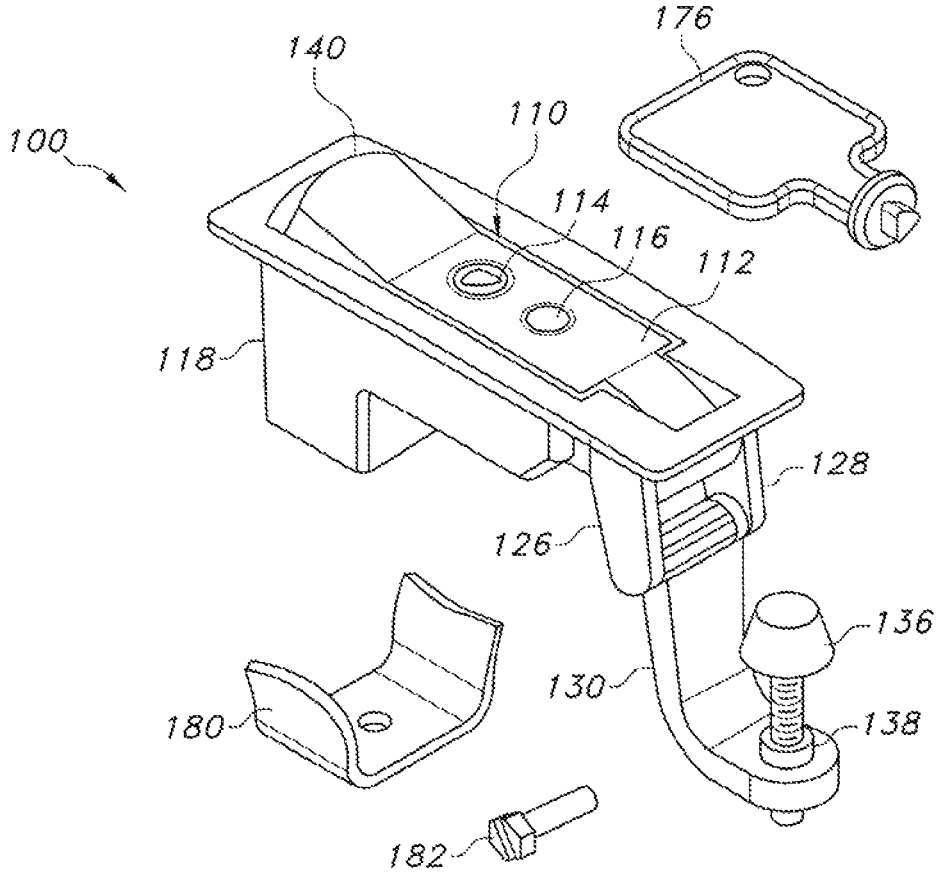
FIG. 1 depicts an exemplary latch system configured for providing an access indication in accordance with aspects of the present invention.

Although the invention is illustrated and described herein with reference to specific embodiments, the invention is not intended to be limited to the details shown. Rather, various modifications may be made in the details within the scope and range of equivalents of the claims and without departing from the invention.

Latches can be retro-fit with mechanical fasteners. For example, plastic "p-clips" can be attached such as by drilling and riveting doors and frames of new and existing storage compartments, resulting in significant expenditures. Such p-clips could then be tagged with a single use plastic seal tag. The door opening process immediately breaks the plastic seal tag and provides an indication that someone has accessed the storage compartment. This may be useful in medical environments, for example, to indicate that a compartment should be refilled when an ambulance returns for cleaning and restocking.

Plastic seal tags are sometimes broken by mistake, even when a compartment's contents remain un-touched. Additionally, plastic seal tags may be expensive, and the process of installing seal tags is time consuming and costly. Due to ever increasing demands to save time and money, such as demands on those involved in the operation of ambulances, it is therefore preferred to provide a simplified mechanism such as by integrating a corresponding or equivalent function within the latch. Such simplification also improves the appearance and aesthetics of the compartments with which the latch may be used, and may also make it easier to observe and monitor the status of the compartments.

The exemplary latches and devices described herein provide a way of identifying when a storage compartment has been accessed, e.g., cleaned or restocked. These embodiments generally incorporate a mechanical indicator that changes state during a first latch operation after reset, but which remains in that state regardless of further closing and opening of the latch, until the indicator is reset by means of a key or special tool. The disclosed embodiments provide added value and save time and money by improving upon disposable plastic tagging operation on storage compartments, e.g. lockers in ambulances. While the invention is described herein primarily with respect to medical or particular ambulance environments, it will be understood that the invention is not so limited. The disclosed latches may be usable on any structure, including any type of storage compartments in which it is desirable to secure or monitor the contents of the compartment, e.g., for audit trail purposes.

The features disclosed herein may be incorporated into conventional compression latches or any other lever-type products. The disclosed latches include a mechanical indicator that changes state (e.g. color) when the lever is released, such as from green to red, to indicate a change from an "unaccessed" state, to an "accessed" state. This "accessed" state indication cannot be influenced or changed by subsequent latching/unlatching operations. Instead, a reset key or tool is required to reset the indicator back to the "unaccessed" state indication. This reset operation can only be completed when the latch is closed.

The disclosed latches are particularly suitable for use on equipment or consumable item storage compartments, which can be accessed by many but replenished by a limited number of operators. The operators may require a simple means of determining whether each compartment has been accessed since the last replenishment cycle, and thus whether it needs to be replenished, rather than by opening each one and checking the contents. Since the latch indictor can only be reset be the key/tool held only by the replenishing operator, it can be confirmed that a compartment with an "unaccessed" indicator does not need checking/replenishing, thus saving significant time during the replenishment process.

With the increasing occurrence of security breaches, theft, and vandalism, the access indicator feature described herein can be the first line of defense in terms of access breach and tampering awareness. It can simply be used in any access controlled environment or can also be utilized in regulated industries such as aerospace where it is required for periodic inspection for presence of life saving devices. This represents a significant time saving where maintenance downtime is at premium cost.

Referring now to the drawings, FIGS. 1-4 illustrate an exemplary latch system 100 configured for providing an access indication in accordance with aspects of the present invention. Latch 100 may be usable to secure and monitor the contents of a storage compartment, for example, in an ambulance or medical environment. As an overview, latch 100 includes an actuator such as lever 110, an indicator 150, and a reset mechanism 170. Although the assembly is described in connection with an actuator in the form of a lever according to exemplary embodiments of this invention, the actuator may alternatively be a handle, a knob, a driver or other actuation device. Also, although the exemplary embodiments shown in the figures illustrate aspects the invention embodied in a compression latch, the invention is contemplated for use in other mechanical devices such as, for example, compression and rotating cam latches, sliding latches, push-to-close latches, locking systems, handle systems, and other devices configured to alternate between positions. Additional details of exemplary assembly 100 are described below for purposes of illustration, but the invention is not limited to such an assembly.

Lever 110 controls the opening and closing of the storage compartment to which latch 100 is attached. Lever 110 has an unopened position (shown in FIG. 1) and an opened position (illustrated later). In the unopened position, lever 110 prevents opening of the door of the storage compartment. In the opened position, lever 110 does not prevent the door of the storage compartment from being opened.

Figure 2:
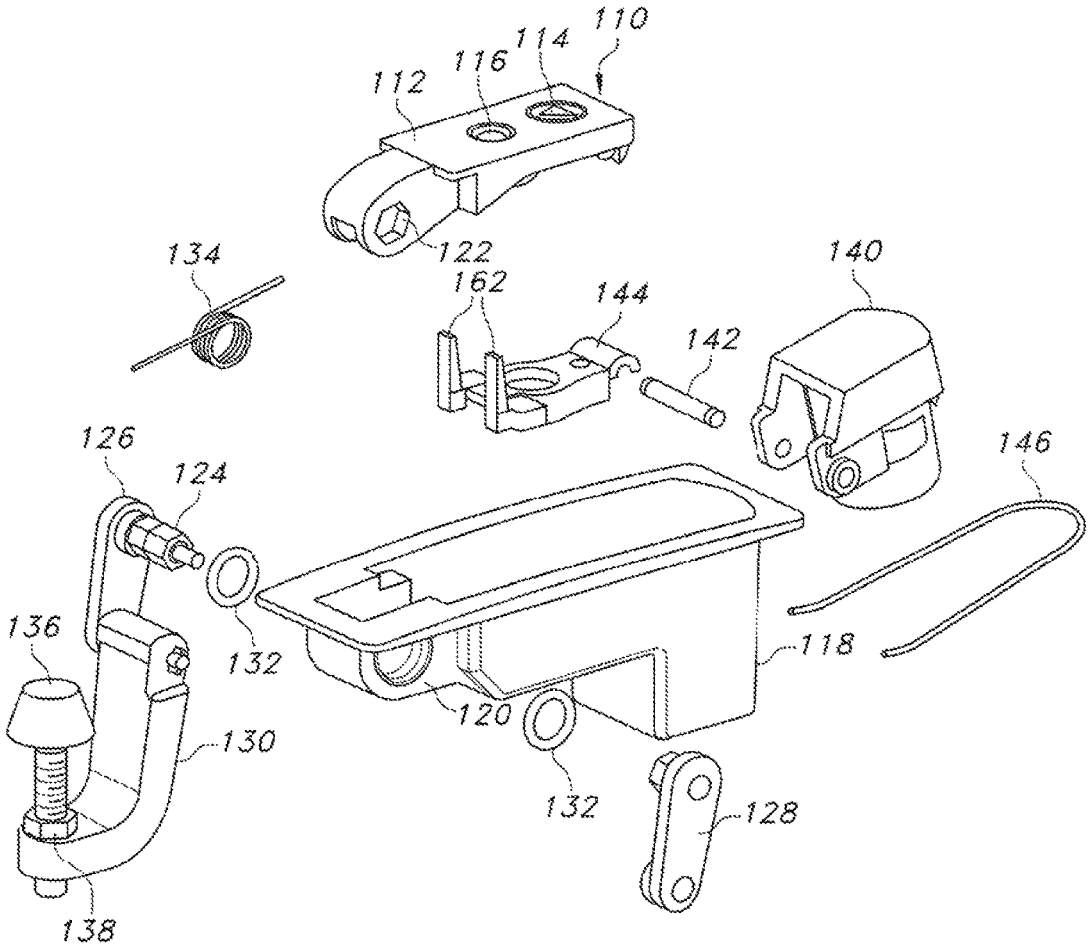
FIG. 2 depicts an exploded view of a latch of the latch system of FIG. 1.
Figure 3:
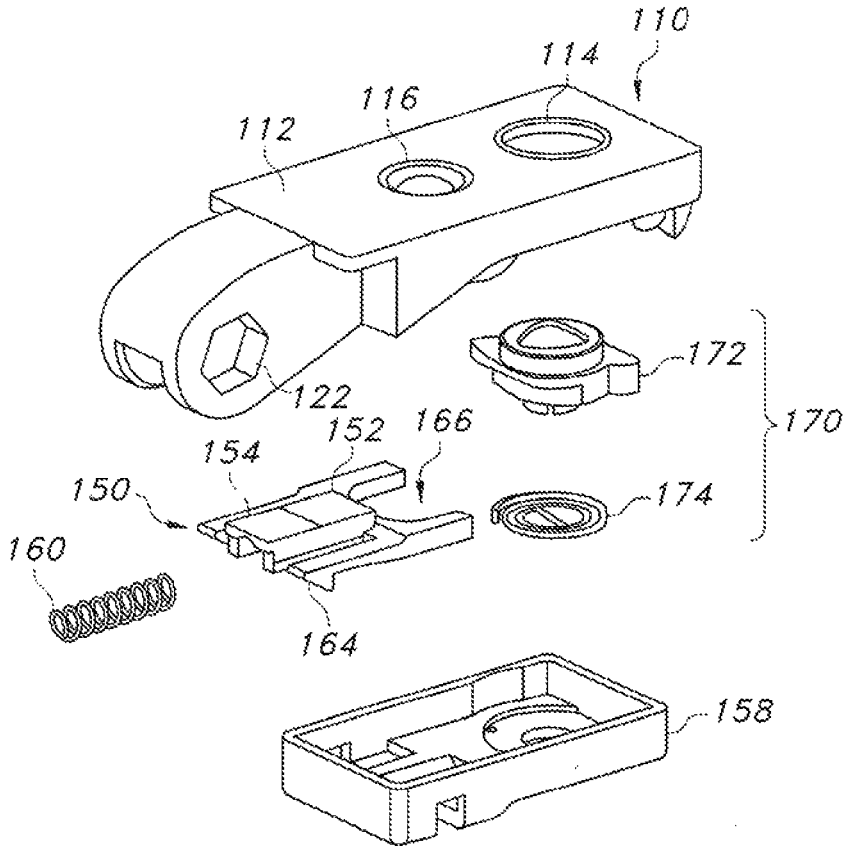
FIG. 3 depicts an exploded view of an exemplary lever of the latch of the latch system of FIG. 1.

In an exemplary embodiment, lever 110 has a front surface 112 including a reset opening 114 and an indicator opening 116, as shown in FIGS. 1-3. Reset opening 114 provides access to the reset mechanism 170 of latch 100, as will be described below. Indicator opening 116 provides a view of the indicator 150 to a user of latch 100.

Lever 110 is positioned within a housing 118, and is pivotable around a pivot axis 120 passing through housing 118. In an exemplary embodiment, lever 110 includes a keyed opening 122, as shown in FIG. 2. The keyed opening 122 is sized to mate with a corresponding keyed pin 124 on a primary crank or pawl 126. Pin 124 passes through the sidewalls of housing 118, and through the keyed opening 122 of lever 110. Primary pawl 126 and pin 124 are retained within housing 118 by a secondary crank or pawl 128 coupled to the end of pin 124. Primary and secondary pawls 126 and 128 maintain housing 118 therebetween, and extend from pin 124 down to arm 130. O-rings 132 may be provided to prevent moisture or dust from entering housing 118 through the openings in its sidewalls accommodating pin 124.

Rotation of lever 110 around pivot axis 120 correspondingly rotates pawls 126 and 128, and arm 130. Latch 100 further includes a torsion spring 134 for rotating lever 110, pawls 126 and 128, and arm 130 relative to housing 118 around pivot axis 120. Spring 134 biases lever 110 to be in the opened position.

Arm 130 includes a bumper screw 136 for preventing opening of the door of the storage compartment, i.e., locking the door to the storage compartment. Bumper screw 136 is screwed into arm 130, and provides the user with a way to adjust the clamping distance of the latch 100 (i.e., by screwing bumper screw 136 in or out). Bumper screw 136 includes a jam nut 138 which can be tightened against arm 130 in order to secure bumper screw 136 in place once a desired clamping distance is reached.

Lever 110, pawls 126 and 128, and arm 130 are held in the unopened position using a trigger or button 140. Although not shown, such a trigger or button can optionally include a lock plug for locking the latch in a closed position. Button 140 is also positioned within housing 118, and is pivotable around a pin 142. Pin 142 is retained in position within housing 118 using a clamp retainer 144 permanently fixed within the interior of housing 118. Button 140 is biased to be in an extended position by U-spring 146, and thereby maintains lever 110 in the unopened position. The free ends of U-spring 146 are also held in place by clamp retainer 144.

In the extended position, the lower edge of the top surface of button 140 contacts a ledge formed on the free end of lever 110. This contact maintains lever 110 in the unopened position. When button 140 is pressed by the user, it pivots about pin 142 until reaching a depressed position. In this position, the lower edge of button 140 moves free from the ledge of lever 110, allowing lever 110 to spring outward under bias from torsion spring 134 toward the opened position.

Indicator 150 is associated with lever 110. Indicator 150 is movable between two positions relative to lever 110 (biased and unbiased positions, as will be described below). In the first position, indicator 150 provides a first indication to a user by way of indicator opening 116, and in the second position, indicator 150 provides a second, different indication to the user by way of indicator opening 116. In an exemplary embodiment, the first indication is a green surface 152, and the second indication is a red surface 154. As will be explained below with respect to the operation of latch 100, indicator 150 is configured to move from the first position (associated with the green indicator) to the second position (associated with the red indicator) when lever 110 is moved from the unopened position toward the opened position.

As shown in FIG. 3, lever 110 includes an indicator housing 158, which with the front surface 112 of lever 110 forms an enclosure for the components of indicator 150. Within this enclosure, indicator 150 is constrained by front surface 112 and housing 158 to slide in a direction along the length of lever 110. Housing 158 also includes a compression spring 160 which biases indicator 150 in a direction toward the outer end of lever 110 (i.e., away from the pivot axis 120). In the unbiased positioned (when spring 160 is compressed), the green surface 152 of indicator 150 is visible through the indicator opening 116 of lever 110. In the biased positioned (when spring 160 is extended), the red surface 154 of indicator 150 is visible through the indicator opening 116 of lever 110.

Clamp retainer 144 includes a pair of protruding upstands 162 extending upward from the lower surface of housing 118, as shown in FIG. 2. When lever 110 is in the unopened position, protruding upstands 162 are positioned to project through openings in indicator housing 158, and contact spring legs 164 formed on the lower side of indicator 150. This abutment retains indicator 150 in the unbiased position, and maintains spring 160 in a compressed state. In this unbiased position, a green indication is provided through indicator opening 116.

When lever 110 is moved from the unopened position toward the opened position, indicator 150 is moved upward and away from protruding upstands 162 (which remain fixed to housing 118). This causes spring legs 164 to move clear of protruding upstands 162, and allows spring 160 to extend, thereby moving indicator 150 into the biased position, and changing the indication provided through indicator opening 116 from green to red. The red indicator signifies to the user that the storage compartment has been accessed.

Figure 4:
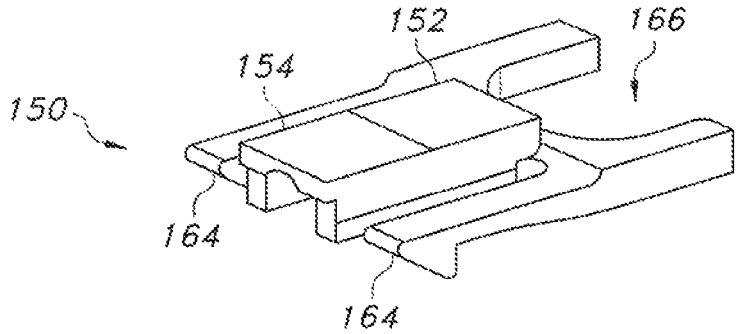
FIG. 4 depicts a perspective view of an exemplary indicator of the latch of the latch system of FIG. 1.

Indicator 150 includes a cut-out portion 166 to accommodate the components of reset mechanism 170 when indicator 150 is in the biased position, as shown in FIG. 4. In the biased position, indicator 150 abuts against reset mechanism 170.

Reset mechanism 170 is associated with indicator 150. Reset mechanism 170 is configured to move indicator 150 from the second (biased) position to the first (unbiased) position. As shown in FIG. 3, reset mechanism 170 includes a reset cam 172 and a coil spring 174. Reset cam 172 is rotatably received within indicator housing 158. Coil spring 174 biases reset cam 172 against a stop feature formed in housing 158. Reset cam 172 includes a keyhole in an upper surface thereof for receiving reset key 176, as will be described below.

Once indicator 150 is moved from the first (unbiased) position to the second (biased) position, indicator remains in that position and continues to display the red indication regardless of any movement of lever 110 or latching or unlatching of latch 100. Indicator 150 is configured to remain in the biased position independent of movement of lever 110 until reset mechanism 170 moves indicator 150 back into the unbiased position. An exemplary reset operation of latch 100 is described below.

Figure 5:
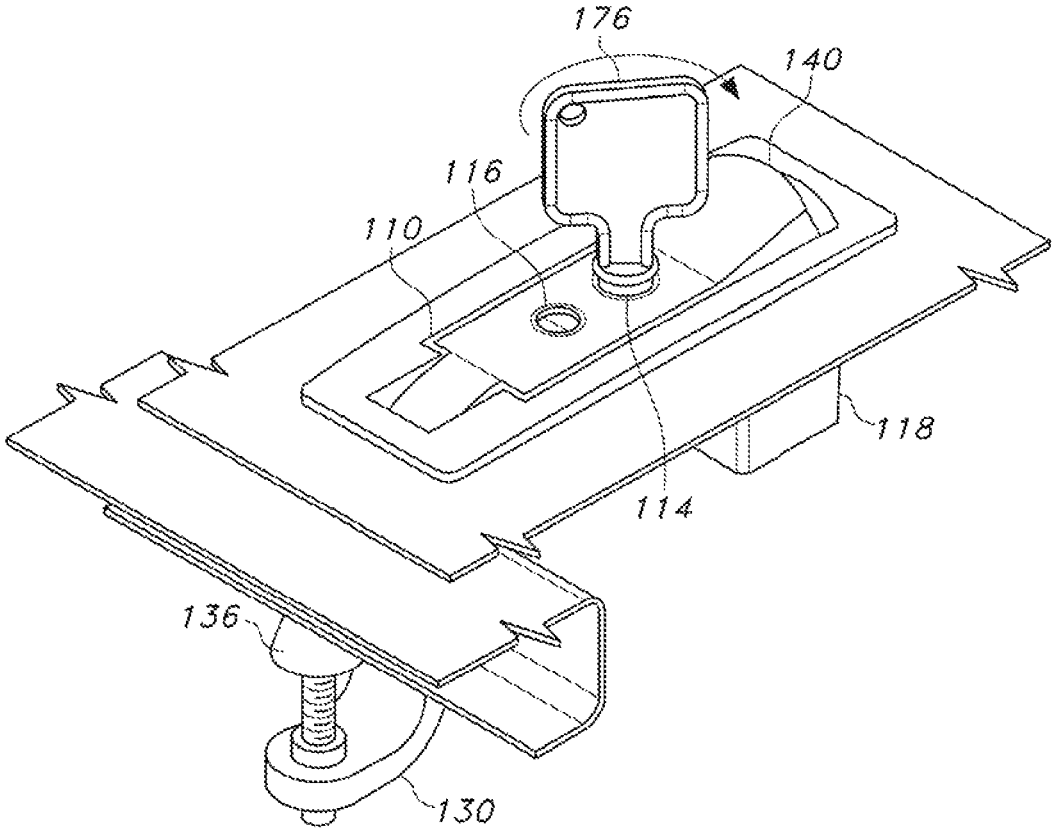
FIG. 5 depicts an exemplary reset operation of the latch system of FIG. 1.

Indicator 150 is reset using a reset key 176 held by the user. To reset the indicator 150, the user inserts key 176 through reset opening 114 and into reset cam 172. Key 176 may have a specific structure designed to mate with reset cam 172, such as a tri-lobe structure. Alternatively, key 176 may be provided with a different structure such as a Philips driver, a flat blade, a hex driver, or any other selected structure After key 176 is inserted, the user rotates key 176 in a clockwise direction, as shown by arrow in FIG. 5. The rotation proceeds until the user hears an audible "click," the sound of protruding upstands 162 re-engaging with spring legs 164. At this time, indicator opening 116 displays the original green indication. Latch 100 remains in this "unaccessed" state until lever 110 is moved toward the open position.

Figure 6A:
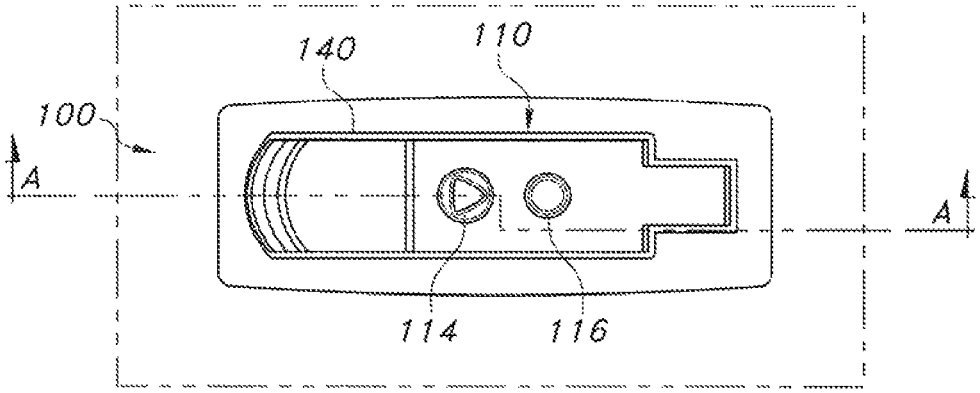
FIGS. 6A and 6B depict a portion of an exemplary storage compartment including the latch of the latch system of FIG. 1.
Figure 6B:
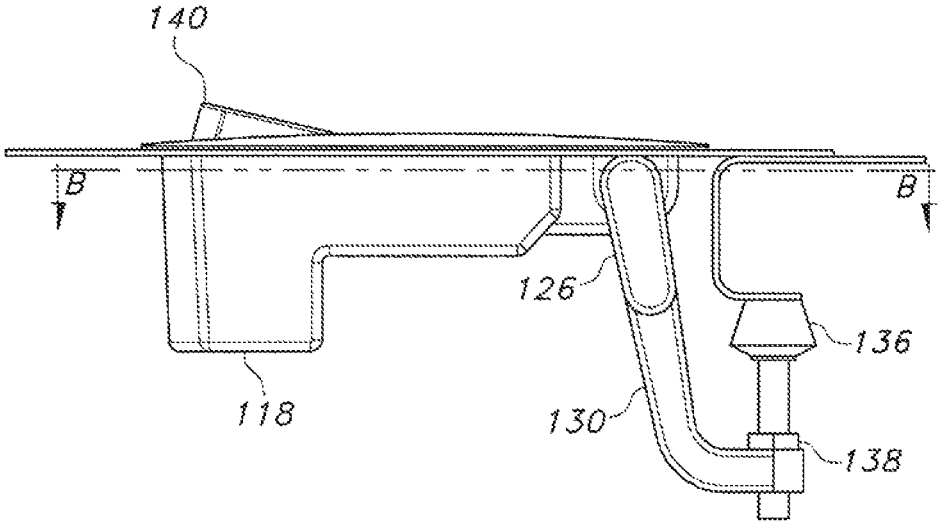

FIGS. 6A and 6B illustrate a portion of an exemplary storage compartment including latch 100 in accordance with aspects of the present invention. Section A-A in FIG. 7A and Section B-B in FIG. 7B show the cross-sectional views provided in FIGS. 8A-12C, discussed below.

FIGS. 7A-7D illustrate the sequence of movements that occur within the lever 110 during the above-described reset operation. The reset operation will now be descripted with reference to these figures.

Figure 7A:
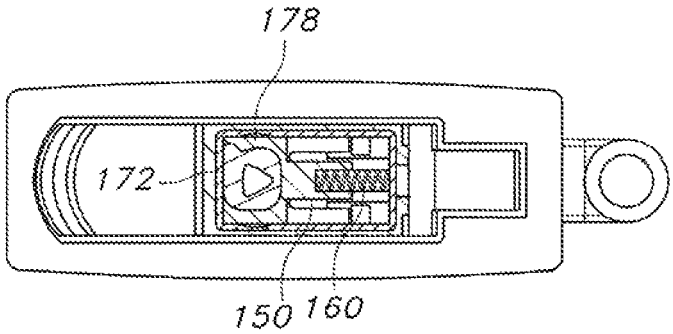
FIGS. 7A-7D depict cross-sectional views of the latch during the reset operation of FIG. 5.

FIG. 7A depicts a state before the reset operation takes place. In this state, indicator 150 is the biased position, and spring 160 is extended. At this stage, reset key 176 is inserted into reset cam 172.

Figure 7B:
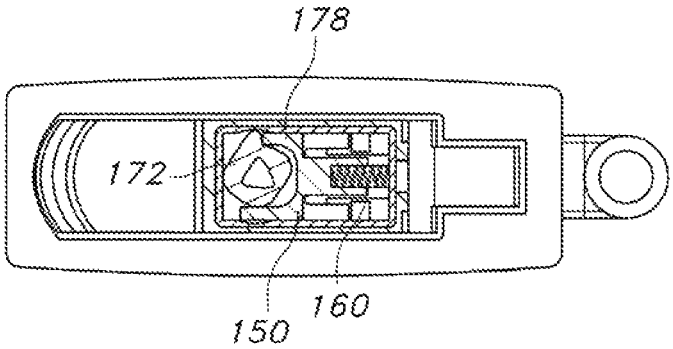

As shown in FIG. 7B, as reset key 176 is rotated in the clockwise direction, the reset cam 172 rotates until it makes contact with a surface 178 on indicator 150. As rotating of reset key 176 continues, indicator 150 begins to slide from the biased position toward the unbiased position, and spring 160 begins to compress.

Figure 7C:
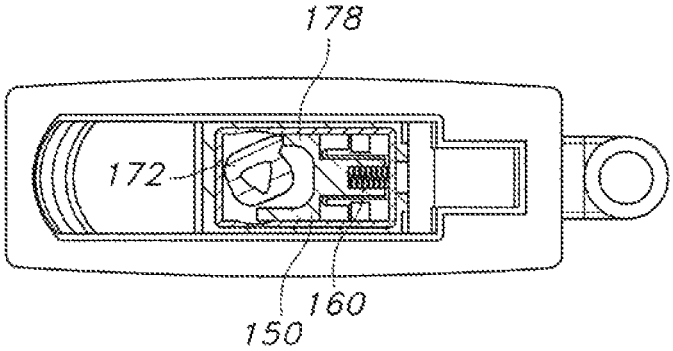

As shown in FIG. 7C, the rotation proceeds until protruding upstands 162 re-engage with spring legs 164, and indicator 150 is held in the unbiased position. At this point, no further rotation of reset cam 172 or reset key 176 is possible. FIGS. 8B, 9B, 10B, 11B, and 12B also provide details regarding the relationship between upstands 162 and spring legs 164. In particular, protruding upstands 162 can only engage with spring legs 164 when lever 110 is in the unopened position, as shown in FIG. 8B.

Figure 7D:
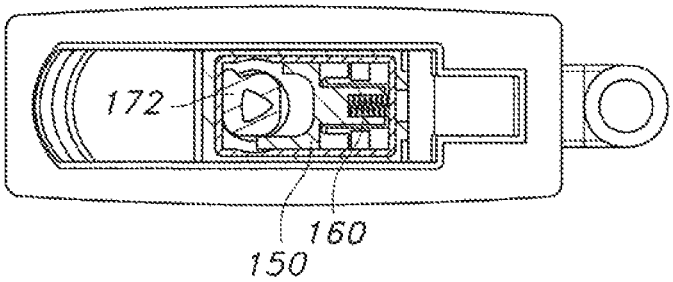

As shown in FIG. 7D, when reset key 176 is removed, reset cam 172 returns to its natural position under bias by coil spring 174, while indicator 150 is held in the unbiased position by the engagement of spring legs 164 with protruding upstands 162.

Latch 100 further includes a mounting bracket 180 and a mounting screw 182 along with reset key 176, as shown in FIG. 1. During installation, latch 100 is fitted into a hole in a panel (such as the door to a storage compartment). Mounting bracket 180 fits around housing 118, and is attached thereto using mounting screw 182.

In an exemplary embodiment, latch 100 may further include a switch that is coupled to a light source. When indicator 150 moves from the first (unbiased) position to the second (biased position), indicator 150 actuates the switch, and the light source is illuminated. Also, or alternatively, latch 100 may be configured for communication with electronics, such as a remote electronic device, to record the state of the latch. The communication can be made by wired or wireless coupling. Such communication can allow for documentation of the latch's state at a given time or time period such as for audit purposes.

Figure 8A:
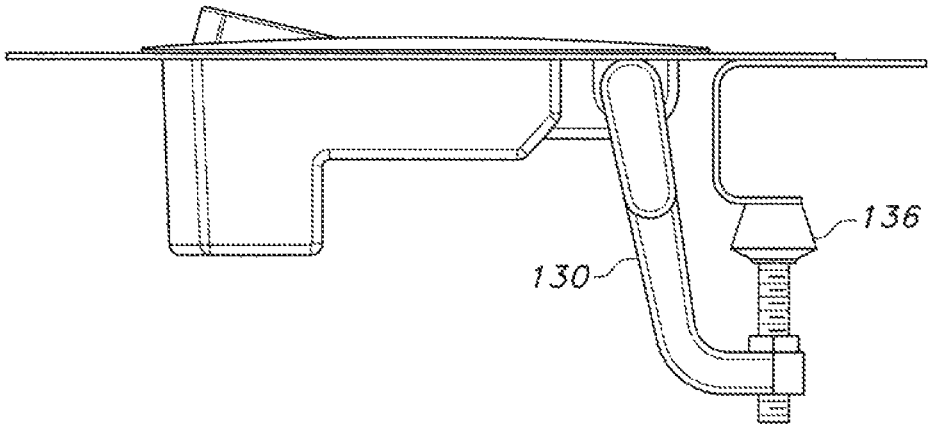
FIGS. 8A-8C depict the latch of FIG. 6B in a closed position and providing an unaccessed indication.
Figure 8B:
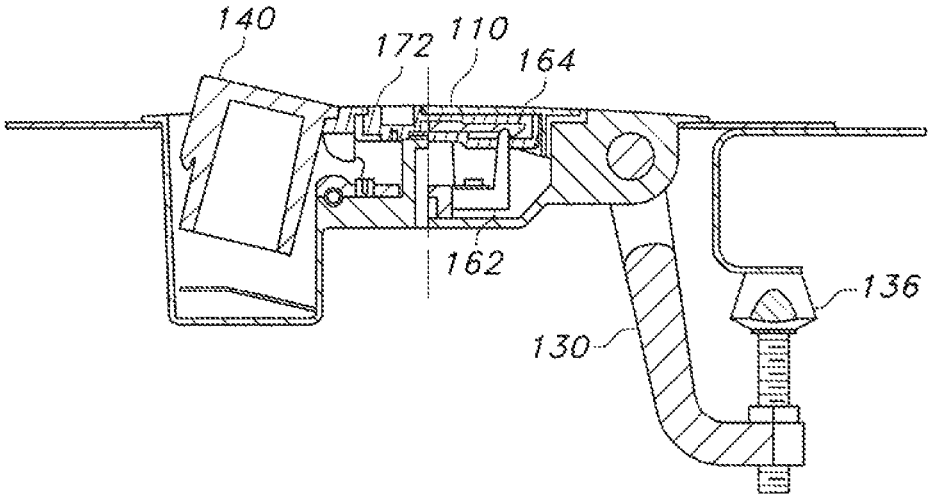
Figure 8C:
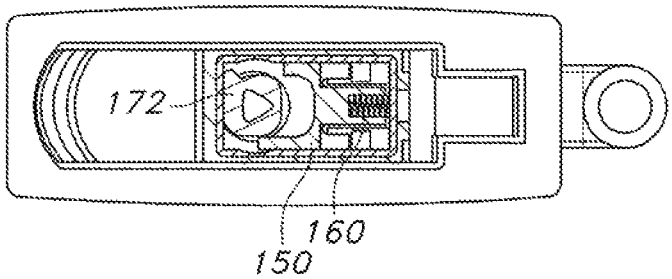

FIGS. 8A-12C show the operation of opening latch 100, during which an access indication is provided. FIGS. 8A-8C illustrate latch 100 in the unopened position. In this position, bumper screw 136 presses against a surface on the storage compartment, thereby locking the door of the storage compartment in place. Likewise, button 140 is biased to be in the extended position by U-spring 146, thereby holding lever 110 in the unopened position. In these figures, indicator 150 is in the first (unbiased) position, and is providing a green indication through the indicator opening 116 in lever 110.

Figure 9A:
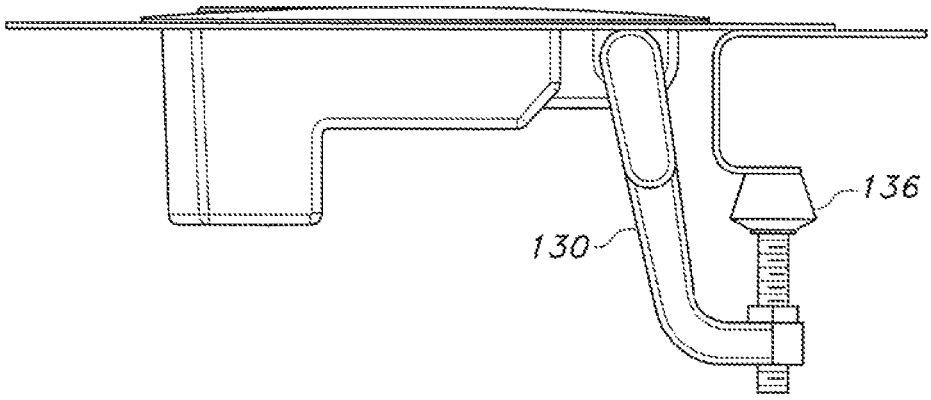
FIGS. 9A-9C depict the latch of FIG. 6B during a first part of an opening operation.
Figure 9B:
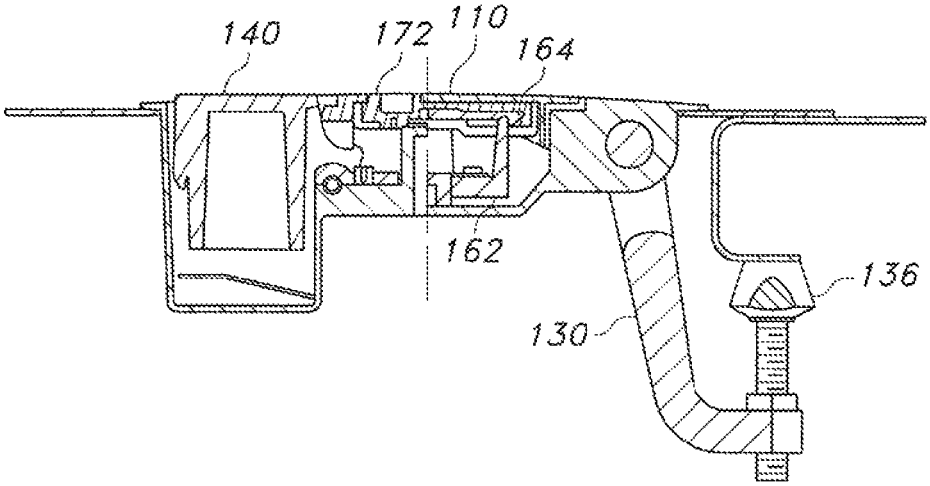
Figure 9C:
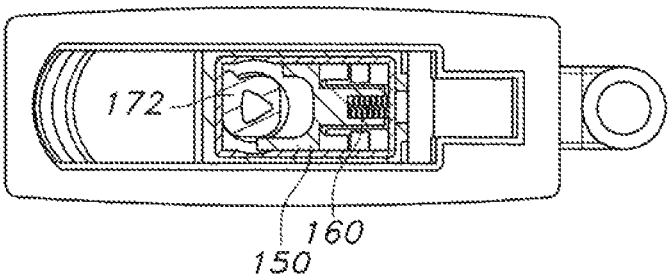

FIGS. 9A-9C illustrate latch 100 with button 140 in the depressed position. Latch 100 reaches this position when a user pressed button 140. When button 140 is pressed by the user, it pivots about pin 142 until reaching a pressed position. In this position, the lower edge of button 140 moves free from the ledge of lever 110, as shown in FIG. 9B.

Figure 10A:
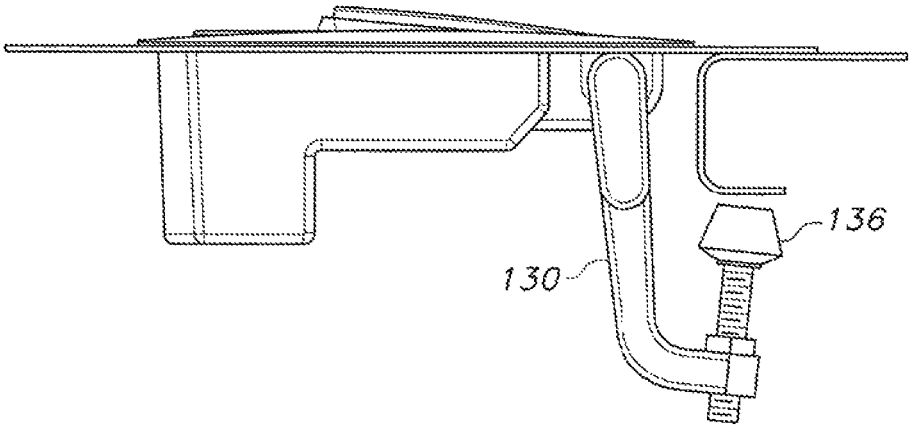
FIGS. 10A-10C depict the latch of FIG. 6B during a second part of an opening operation.
Figure 10B:
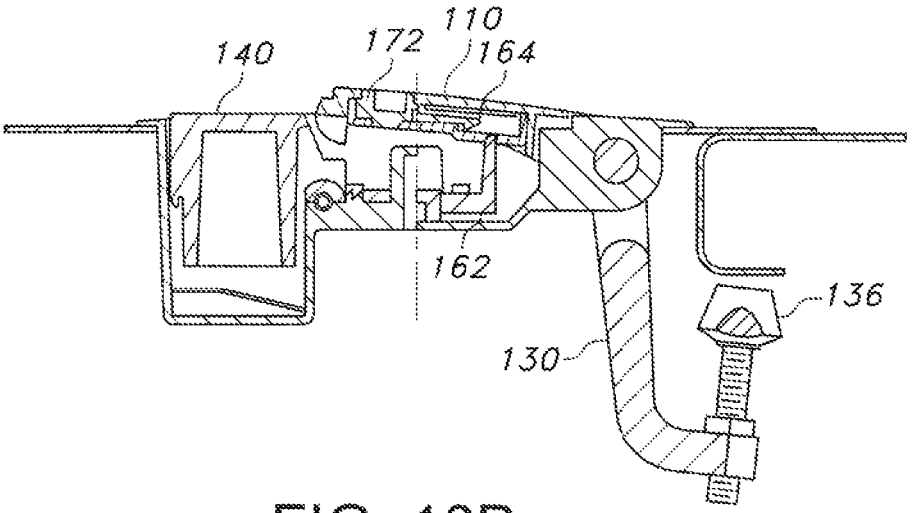
Figure 10C:
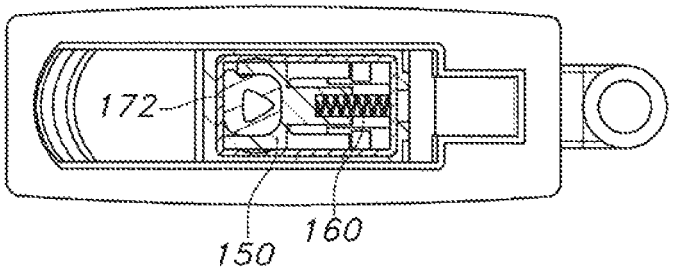

FIGS. 10A-10C illustrate latch 100 as lever moves from the unopened position. After the lower edge of button 140 moves free from the ledge of lever 110, lever 110 begins to spring outward under bias from torsion spring 134 toward the opened position. Alternatively, the spring can be configured to provide a bias in an opposite direction such as toward the closed position. When lever 110 begins this movement from the unopened position toward the opened position, indicator 150 is moved upward and away from protruding upstands 162 (which remain fixed to housing 118). This causes spring legs 164 to move clear of protruding upstands 162, and allows spring 160 to extend, thereby moving indicator 150 into the biased position, and changing the indication provided through indicator opening 116 from green to red.

Figure 11A:
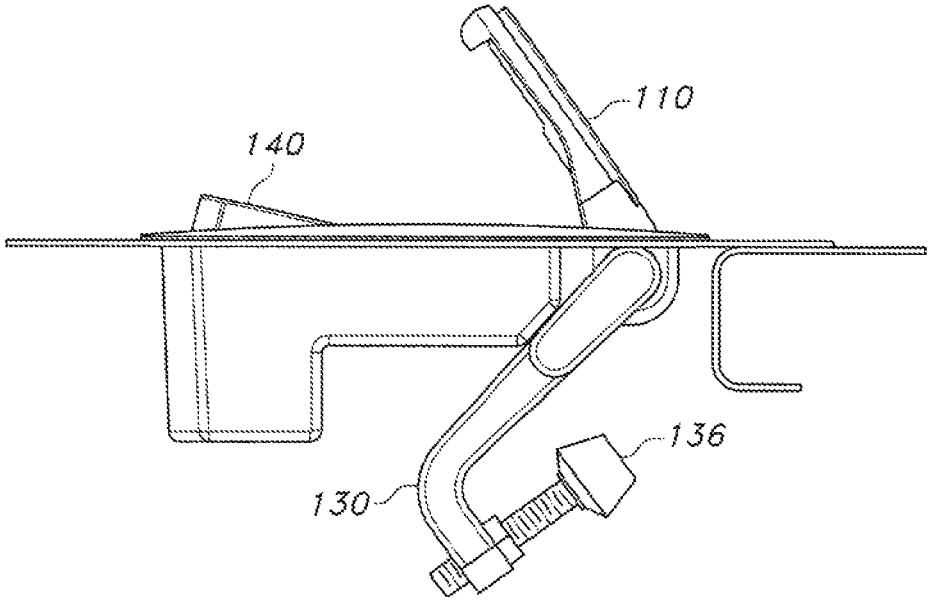
FIGS. 11A and 11B depict the latch of FIG. 6B in an open position.
Figure 11B:
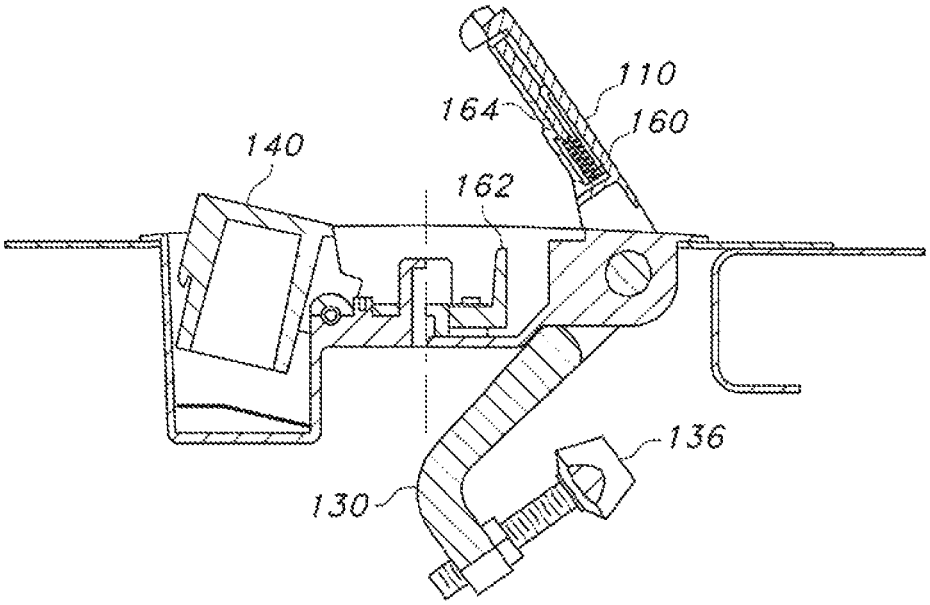

FIGS. 11A and 11B illustrate latch 100 with lever 110 in the opened position. Indicator 150 remains in the second "accessed" position throughout movement of the lever 110. In this opened position, bumper screw 136 is moved clear of the surface on the storage compartment, thereby unlocking the door of the storage compartment and allowing access to the contents of the compartment.

Figure 12A:
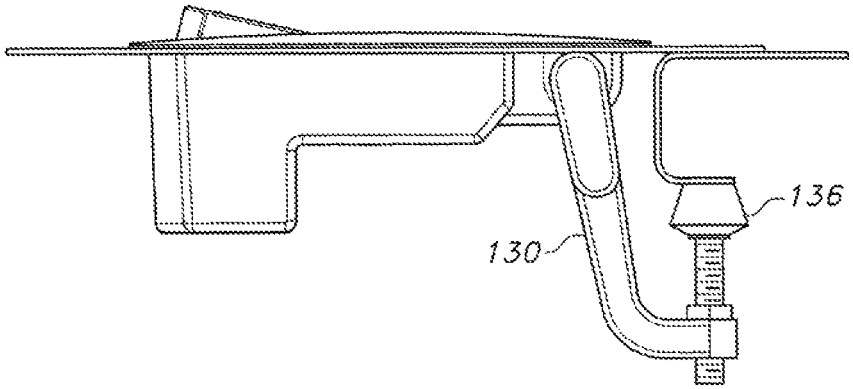
FIGS. 12A-12C depict the latch of FIG. 6B in a closed position and providing an accessed indication.
Figure 12B:
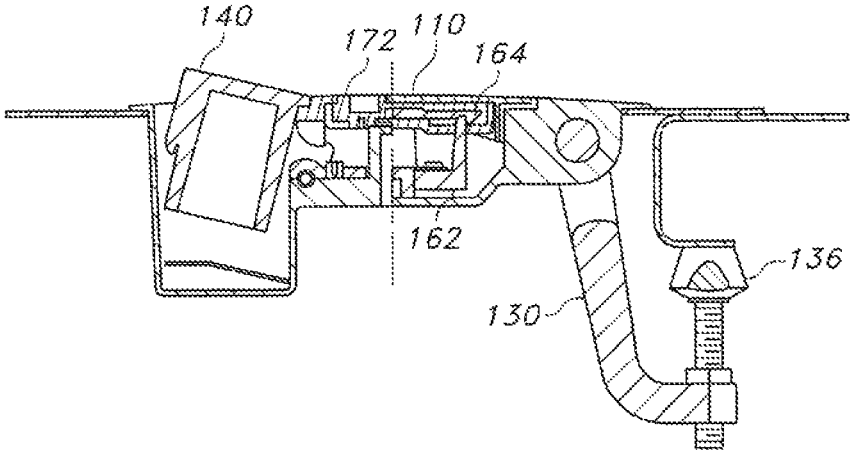
Figure 12C:
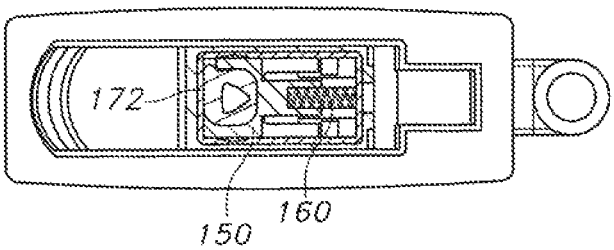

FIGS. 12A-12C illustrate latch 100 having returned to the unopened position after being accessed. In this position, bumper screw 136 presses against a surface on the storage compartment, thereby locking the door of the storage compartment in place. Indicator 150 remains in the second "accessed" position throughout movement of the lever 110, and can only be returned to the first position using the reset operation described above with respect to FIG. 5.

In the embodiments illustrated in the figures, when lever 110 is rotated from the unopened position toward the opened position, indicator 150 slides. It is also contemplated that the respective components of the mechanism can be reversed or otherwise mounted for different motion with respect to one another. In other words, for example, the device may include a sliding actuator or reset mechanism with a rotating indicator. In such an arrangement, the indicator is optionally mounted for rotational movement (as opposed to sliding movement) and the actuator is optionally mounted for sliding movement (as opposed to rotational movement) with respect to the indicator.

In the various embodiments illustrated in the figures and variations of those embodiments, devices according to this invention preferably indicate that the device has been opened even after it has been re-closed. In other words, while the invention contemplates devices that indicate an opened condition when the device is opened and a closed condition when the device is re-closed, preferred devices according to this invention differ in that they indicate an opened condition when the device is opened and continue to indicate the opened condition even after the device is re-closed one or more times, at least until the device is reset to indicate the closed condition.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed:

1. A latch configured for providing an access indication, the latch comprising:

a housing;

at least one fixed surface associated with the housing;

an actuator movable relative to the housing between an unopened position and an opened position;

an indicator associated with the actuator and configured to contact the at least one fixed surface associated with the housing, the indicator having a first position in which a first indication is provided and a second position in which a second indication is provided different from the first indication, the indicator configured to release from contact with the at least one fixed surface associated with the housing and move from the first position to the second position when the actuator is moved from the unopened position toward the opened position; and wherein the indicator, once moved from the first position to the second position, is configured to remain in the second position independent of movement of the actuator.

2. The latch recited in claim 1, wherein the actuator comprises at least one opening, and the first and second indications are provided by way of the at least one opening of the actuator.

3. The latch recited in claim 1, wherein the indicator is held in the first position only when the actuator is in the unopened position.

4. The latch recited in claim 1, wherein in the first position the indicator displays a first color and in the second position the indicator displays a second color different from the first color.

5. The latch recited in claim 1, further comprising a spring configured to urge the indicator from the first position toward the second position when the actuator is moved from the unopened position toward the opened position.

6. The latch recited in claim 1, wherein the indicator comprises one or more projections positioned to engage with one or more other projections of the latch when the actuator is in the unopened position.

7. The latch recited in claim 6, wherein movement of the actuator from the unopened position toward the opened position causes disengagement of the one or more projections of the indicator from the one or more other projections, allowing the indicator to move from the first position to the second position.

8. The latch recited in claim 1, further comprising a reset mechanism associated with the indicator, the reset mechanism configured to move the indicator from the second position to the first position; the reset mechanism comprising a keyhole sized to receive a key, such that rotation of the key moves the indicator from the second position to the first position.

9. The latch recited in claim 8, wherein the reset mechanism comprises a reset cam positioned to engage a surface of the indicator, such that rotation of the key causes the reset cam to apply force to the surface of the indicator and to push the indicator toward the first position.

10. The latch recited in claim 1, further comprising a switch and a light coupled to the switch, wherein the indicator is positioned to actuate the switch when the indicator is moved to the first position or the second position.

11. A latch system comprising the latch recited in claim 1 and a key configured to move the indicator from the second position to the first position.

12. The latch recited in claim 1, further comprising a spring configured to urge the actuator from the unopened position to the opened position.

13. The latch recited in claim 1, further comprising a spring configured to urge the actuator from the opened position to the unopened position.

14. The latch recited in claim 1, further comprising a trigger positioned to selectively prevent the actuator from moving from the unopened position toward the opened position.

15. The latch recited in claim 14, the trigger comprising a button.

16. The latch recited in claim 14, further comprising a lock associated with the trigger.

17. A latch system comprising the latch recited in claim 1 and electronics associated with the latch, the electronics being configured to detect the state of the actuator of the latch in the unopened position or the opened position and/or the state of the indicator in the first position or the second position.

18. The latch system of claim 17, the electronics being configured to document the state of the actuator of the latch and/or the state of the indicator.

19. The latch system of claim 17, the electronics being configured to record the state of the actuator of the latch and/or the state of the indicator at a time or during a period of time.

20. The latch of claim 1, wherein the at least one fixed surface is defined by a projection affixed to the housing.

21. The latch of claim 20, wherein the actuator is provided at an upper portion of the housing when the actuator is in the unopened position, and the projection is an upstand extending from a lower surface of the housing opposite the actuator.

22. The latch of claim 1, wherein:

the actuator comprises a lever which is pivotable relative to the housing between the unopened position and the opened position, the indicator is movable relative to the lever between the first position and the second position, and the first and second indications are provided through an opening in the lever.

* * * * *